US009480287B2

(12) United States Patent
Black et al.

(10) Patent No.: US 9,480,287 B2
(45) Date of Patent: Nov. 1, 2016

(54) ATHLETIC BRA

(71) Applicant: HBI Branded Apparel Enterprises, LLC, Winston-Salem, NC (US)

(72) Inventors: Karen J Black, Wilton, CT (US); Jewel L Brown, Jersey City, NJ (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 125 days.

(21) Appl. No.: 13/971,931

(22) Filed: Aug. 21, 2013

(65) Prior Publication Data

US 2015/0056890 A1 Feb. 26, 2015

(51) Int. Cl.

| | |
|---|---|
| ***A41C 3/00*** | (2006.01) |
| ***A41F 15/00*** | (2006.01) |
| ***A41C 3/10*** | (2006.01) |
| ***A41C 3/14*** | (2006.01) |

(52) U.S. Cl.

CPC ..... *A41C 3/0057* (2013.01); *A41C 3/0014* (2013.01); *A41C 3/10* (2013.01); *A41C 3/146* (2013.01); *A41F 15/002* (2013.01); *A41F 15/007* (2013.01)

(58) Field of Classification Search

CPC .. A41C 3/005; A41C 3/0057; A41C 3/0085; A41C 3/00; A41C 3/0014; A41C 3/0021; A41C 3/14

See application file for complete search history.

(56) References Cited

U.S. PATENT DOCUMENTS

| | | | | | |
|---|---|---|---|---|---|
| 2,721,323 | A | * | 10/1955 | Spanel | A41C 3/0014 450/39 |
| 2,971,514 | A | * | 2/1961 | Steinmetz | A41C 3/00 450/70 |
| 3,381,689 | A | * | 5/1968 | Sachs | A41C 3/00 450/59 |
| 3,478,747 | A | * | 11/1969 | Sachs | A41C 3/00 450/59 |
| 3,548,833 | A | * | 12/1970 | Lavergne | 450/60 |
| 3,623,487 | A | * | 11/1971 | Chiu | A41C 3/0021 2/323 |
| 4,781,651 | A | * | 11/1988 | Ekins | A41C 3/0057 450/25 |
| 5,022,887 | A | * | 6/1991 | Lawson | A41C 3/10 2/267 |
| 5,167,566 | A | * | 12/1992 | Novitsky | A41C 3/00 2/67 |
| 5,660,577 | A | | 8/1997 | Modena | |
| D403,486 | S | | 1/1999 | Chetwynd | |

(Continued)

FOREIGN PATENT DOCUMENTS

| | | | |
|---|---|---|---|
| EP | 1226767 | | 7/2002 |
| GB | 980609 | * | 1/1965 |

(Continued)

OTHER PUBLICATIONS

"Champion Women's Marathon Sports Bra", posted on-line for sale to Dicks Sporting Goods with product reviews as early as Aug. 2, 2014. Retrieved from internet on Oct. 6, 2014. URL: http://www.dickssportinggoods.com/product/index.jsp?productId=28977566. (2 pages).

(Continued)

*Primary Examiner* — Andrew W Collins
*Assistant Examiner* — Brieanna Szafran
(74) *Attorney, Agent, or Firm* — Fish & Richardson P.C.

(57) ABSTRACT

A bra having a front portion, a back portion, a torso band and a pair of shoulder straps. Areas of the front portion are selectively provided with an inner ply, an outer ply, and an intermediate fabric ply. The intermediate fabric ply is formed of a relatively supportive material and is configured to be positioned along the top and lateral sides of a wearer's breasts.

19 Claims, 4 Drawing Sheets

(56) References Cited

U.S. PATENT DOCUMENTS

| | | | | |
|---|---|---|---|---|
| 5,873,768 | A | 2/1999 | Fleischman-Ament et al. | |
| 6,083,080 | A * | 7/2000 | Lawson | A41C 3/0057 450/39 |
| 6,306,006 | B1 * | 10/2001 | Cheng | A41C 3/10 2/267 |
| 6,425,800 | B1 * | 7/2002 | Huang | A41C 3/0007 450/41 |
| 6,688,942 | B2 | 2/2004 | Holliday | |
| 6,846,217 | B1 * | 1/2005 | Struble | A41C 3/08 2/78.1 |
| 7,081,035 | B2 | 7/2006 | Kawakami | |
| 7,131,888 | B2 | 11/2006 | Hsu | |
| 7,214,121 | B1 * | 5/2007 | Huang | A41C 3/10 450/38 |
| 7,435,155 | B2 * | 10/2008 | Reinisch et al. | 450/59 |
| 7,833,082 | B2 | 11/2010 | Bugada | |
| 7,963,822 | B2 | 6/2011 | Simpson | |
| D641,954 | S | 7/2011 | Glass | |
| 8,137,155 | B2 * | 3/2012 | Horii | A41C 3/08 450/59 |
| 8,142,256 | B2 * | 3/2012 | Rose | A41C 3/10 450/39 |
| 8,465,341 | B2 | 6/2013 | Shashy | |
| 8,690,634 | B2 | 4/2014 | Heath et al. | |
| 8,771,036 | B2 | 7/2014 | Gentry et al. | |
| 8,777,693 | B2 | 7/2014 | Shashy | |
| 2001/0019933 | A1 * | 9/2001 | Wagner | A41C 3/0057 450/37 |
| 2002/0022433 | A1 * | 2/2002 | Yeung et al. | 450/70 |
| 2003/0040256 | A1 * | 2/2003 | Waitz | 450/86 |
| 2004/0224603 | A1 * | 11/2004 | Kaye | A41C 3/0085 450/1 |
| 2006/0025039 | A1 * | 2/2006 | Barbour et al. | 450/1 |
| 2007/0190896 | A1 * | 8/2007 | Yu | A41O 5/005 450/39 |
| 2008/0051005 | A1 * | 2/2008 | Huang | 450/92 |
| 2009/0081924 | A1 * | 3/2009 | Puyaubreau | A41C 3/14 450/39 |
| 2009/0117824 | A1 * | 5/2009 | Jian | A41C 3/14 450/38 |
| 2009/0305608 | A1 | 12/2009 | Bonnin et al. | |
| 2010/0005569 | A1 * | 1/2010 | Sanders | 2/400 |
| 2010/0267313 | A1 * | 10/2010 | Allen | A41C 3/00 450/39 |
| 2011/0217904 | A1 * | 9/2011 | Smith | A41C 3/00 450/86 |
| 2012/0094575 | A1 * | 4/2012 | Sokolowski et al. | 450/92 |
| 2012/0122370 | A1 * | 5/2012 | Heath et al. | 450/80 |
| 2013/0065485 | A1 * | 3/2013 | Goodwin | A41C 3/10 450/41 |
| 2013/0225042 | A1 | 8/2013 | Ave et al. | |

FOREIGN PATENT DOCUMENTS

| | | |
|---|---|---|
| WO | W02013/056344 | 4/2013 |
| WO | WO2013156344 A1 | 10/2013 |

OTHER PUBLICATIONS

"Champion Announces New Marathon Bra", posted on-line to Good Housekeeping on Nov. 14, 2013. Retrieved from the internet on Oct. 7, 2014. URL: http://www.goodhousekeeping.com/product-reviews/research-institute/champion-marathon-bra-review. (5 pages).

"Champion Marathon Bra—Women's" posted on-line for sale to Lady Footlocker with product reviews as early as Jan. 13, 2014. Retrieved from the internet on Oct. 6, 2014: URL: http://ladyfootlocker.com/product/model:207788/sku:B67045KW/champion-marathon-bra-womens. (3 pages).

"Champion Marathon Sports Bra", posted on-line for sale to Champion USA with product reviews as early as Jan. 3, 2014. Retrieved from the Internet on Oct. 6, 2014. URL: http://www.championusa.com/workout-clothes/women/sports-bras/view-all-sports-bras-85069--1/championusa. (4 pages).

PCT International Search Report and Written Opinion of the International Searching Authority, PCT/US2014/051422, Oct. 31, 2014, 9 pages.

The State Intellectual Property Office of the People's Republic of China, Notification of First Office Action, Chinese Application No. 201480046152.3, Jun. 6, 2016, 15 pages.

Australian Government IP Australia, Patent Examination Report No. 1, Patent Application No. 2014309080, Jul. 8, 2016, 3 pages.

* cited by examiner

ATHLETIC BRA

CROSS-REFERENCE TO RELATED APPLICATION

This application is related to co-pending U.S. Design Pat. Application No. 29/464,793,filed Aug. 21, 2013.

FIELD OF INVENTION

This disclosure is related to foundation garments, particularly brassieres. More particularly, this disclosure provides for a bra, primarily an athletic bra, having improved comfort and/or support.

BACKGROUND OF THE INVENTION

Brassieres, particularly athletic or sports brassieres are available in a variety of constructions. Generally, these sports bras are designed to provide increased levels of support to a woman's breasts, often by compression, in order to reduce movement of the breasts during exercise. In some cases, women have been known to require the simultaneous use of more than one bra in order to provide their desired level of support and control. Even for women with smaller breasts, shifting of the wearer's torso, especially during athletic endeavors, can create circumstances where the wearer's bra becomes uncomfortable. Common complaints include chaffing of brassiere material against the wearer's skin, undesired movement of a torso band up or down, as well as failure to manage perspiration.

There remains a need for a bra, particularly, an athletic bra, that provides improvements over the prior art in one or more of the problem areas discussed above.

SUMMARY

In at least a first embodiment, the present disclosure provides for a bra having a front portion configured to cover the breasts of a wearer; a back portion connected to the front portion to surround the torso of the wearer; and a torso band attached along a bottom edge of the front portion and the back portion. In at least this first embodiment, the bra includes a ply of supportive fabric disposed between inner and outer plies forming the front portion of the bra. The supportive fabric ply includes at least one first portion positioned at the top of the front portion and a pair of second portions positioned to correspond with the lateral sides of the wearer's breasts.

In at least a second embodiment, the present disclosure provides for a bra having a front portion configured to cover the breasts of a wearer; a back portion connected to the front portion to surround the torso of the wearer; and a torso band attached along a bottom edge of the front portion and the back portion. In at least this second embodiment, the back portion of the bra includes a torso encircling portion and a connector portion. The torso encircling portion has a bottom edge attached to the torso band and a top edge spaced from the torso band. The torso encircling portion is disposed along the torso band to join with each lateral side of the front portion. The connector portion projects upwardly from the torso band and is sewn at the torso and the upper edge of the torso encircling portion.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

BRIEF DRAWING DESCRIPTIONS

DETAILED DESCRIPTION OF THE DRAWINGS

Explanatory embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

As used here, the terms "inner" and "inside" are used to describe items or features intended to be relatively near the body or skin of the wearer. By contrast, the terms "outer" or "outside" are used to describe items or features intended to be located away from the body or the skin of the wearer relative to other elements. Further, terms such as "upper," "upward," "top," "above" and the like are used to describe items or features intended to be located in the relative direction of the wearer's head or shoulders. By contrast, terms such as "lower," "downward," "bottom," "below" and the like are used to describe items or features intended to be located relatively toward the waist or hips of the wearer when in use.

Figure 1:
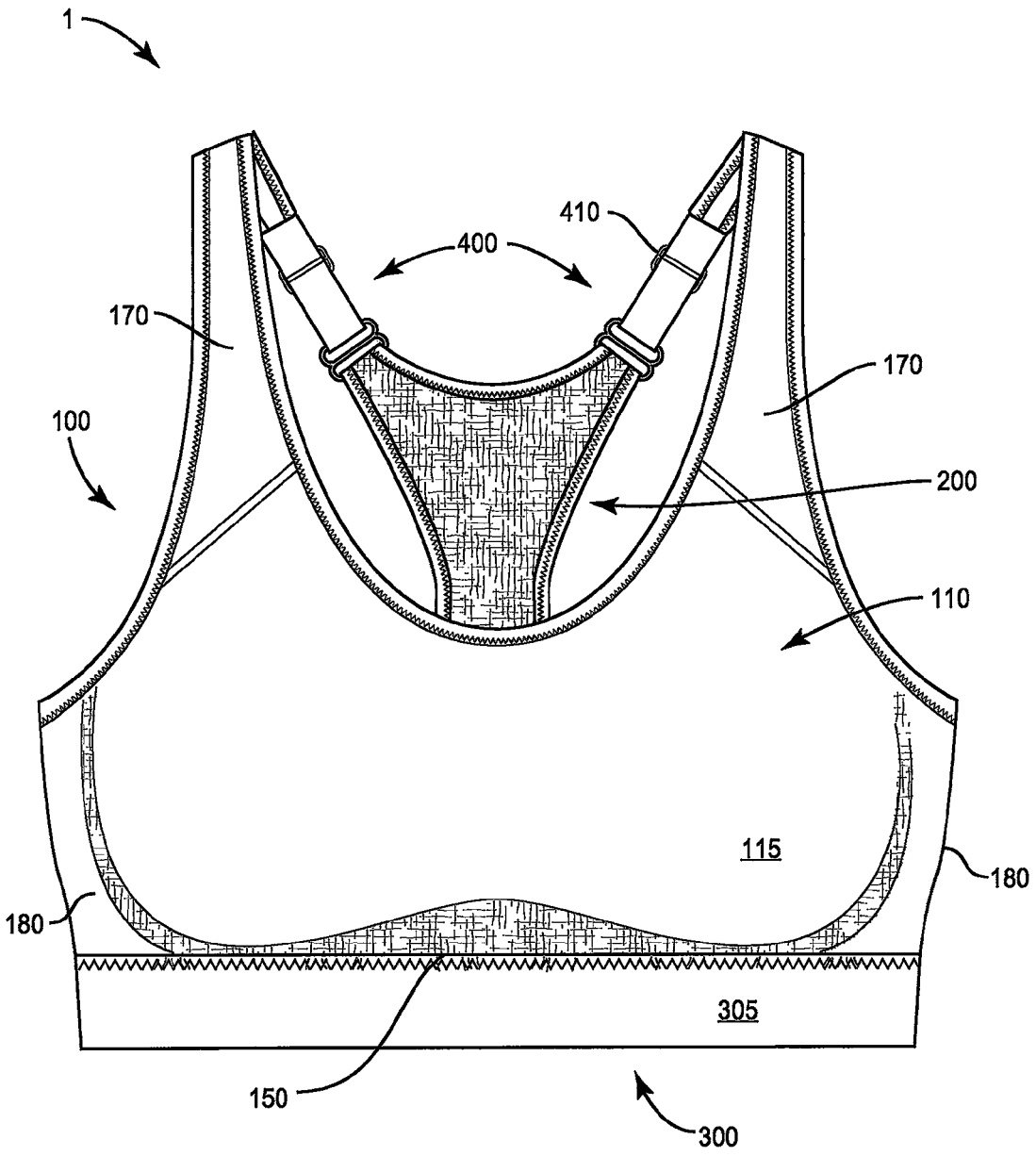
FIG. 1 is an outer, front view of a bra according to embodiments of the present disclosure.
Figure 2:
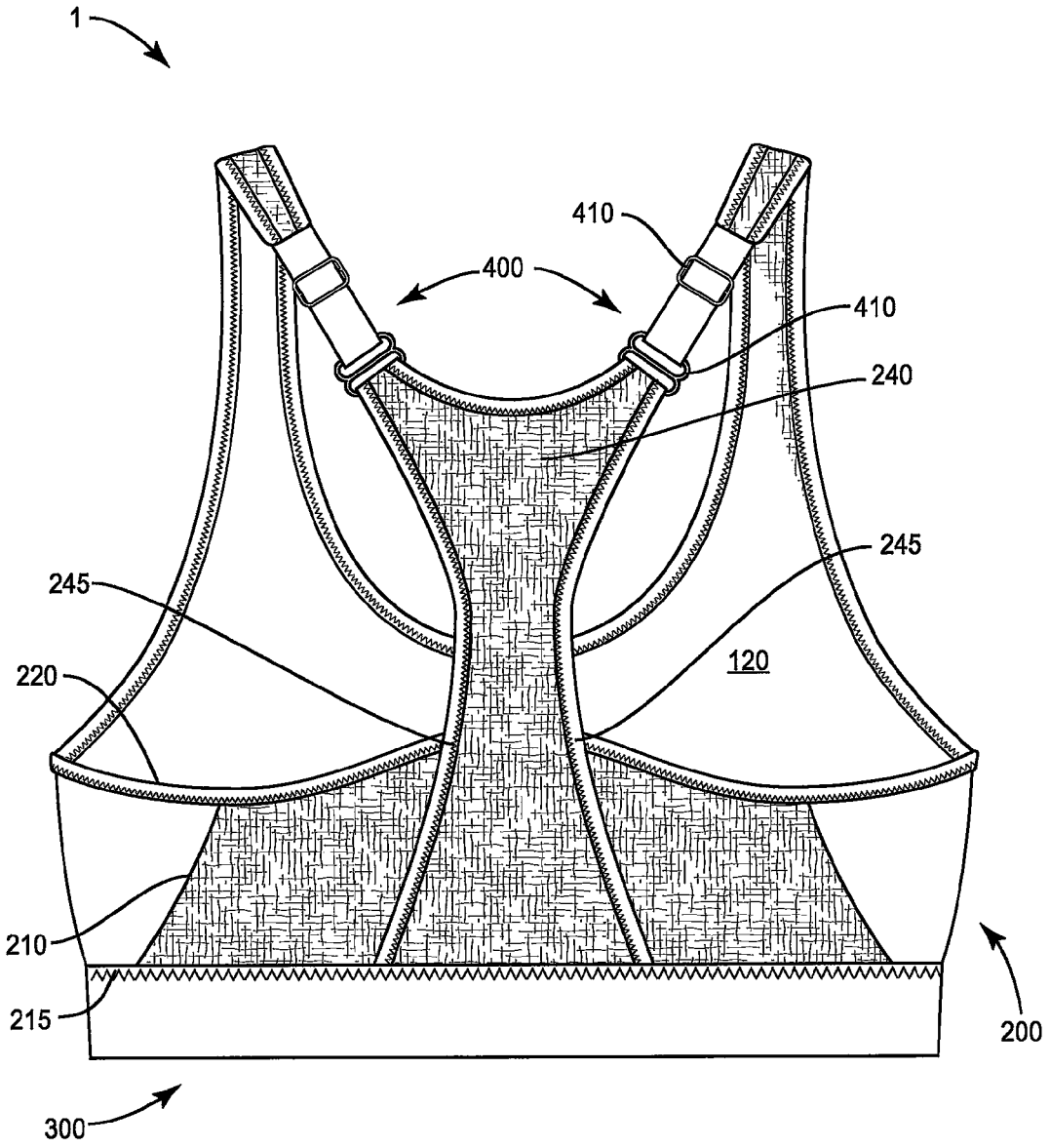
FIG. 2 is an outer, back view of a bra according to embodiments of the present disclosure.

With reference to the drawings, in particular FIGS. 1 and 2, a bra 1 is illustrated according to an embodiment of this disclosure. The bra 1 includes a front portion 100, a back portion 200, a torso band 300 and a pair of shoulder straps 400. In the illustrated embodiment, the bra 1 is shown generally as a sports bra or an athletic bra. However, a bra 1 having the features as described in this disclosure may be worn by the user at any time for any activity of the user's choosing. In other words, the bra 1 of the present disclosure is understood to provide comfort and support at all times, not only when the wearer is engaged in athletic activities.

As seen in FIG. 1, the front portion 100 of the bra 1 can define a plurality of sections. These sections include a bust/breast region 110, a brace region 150, a pair of lateral regions 180, and a pair of shoulder portions 170. The bust region 110 is configured to encompass a majority of the front portion 100. The bust region 110 is adapted to cover the bust or breasts of a wearer. The bust region 110 may or may not be molded or shaped to predefine separate cups for the wearer's breasts. At least part of the bust region 110 is provided with at least a three ply construction, having an outer fabric ply 115, an inner fabric ply 120 (see FIG. 2), and an intermediate fabric ply 125 (see FIG. 4). The outer fabric ply 115 and the inner fabric ply 120 may comprise a knit fabric having about 82% nylon and 18% spandex tricot. The disclosure, however, is not limited to the use of such fabric for the inner and outer fabric plies and other suitable fabrics are within the scope of the disclosure, including, for example, fabrics made of rayon, polyester, polypropelene and other elastomeric yarns. Preferably, at least the outer fabric ply 115 and the inner fabric ply 120 are provided with a treatment or coating for enhancing the ability of the ply to wick moisture from the skin. More preferably, the wicking capability of the fabric will be able to increase as the temperature surrounding the bra 1 increases, such as when the wearer is in the midst of a workout. One such treatment considered to provide the desired temperature dependent wicking includes the Adaptive™ treatment available from HeiQ Materials AG of Zurzach, Switzerland.

Figure 4:
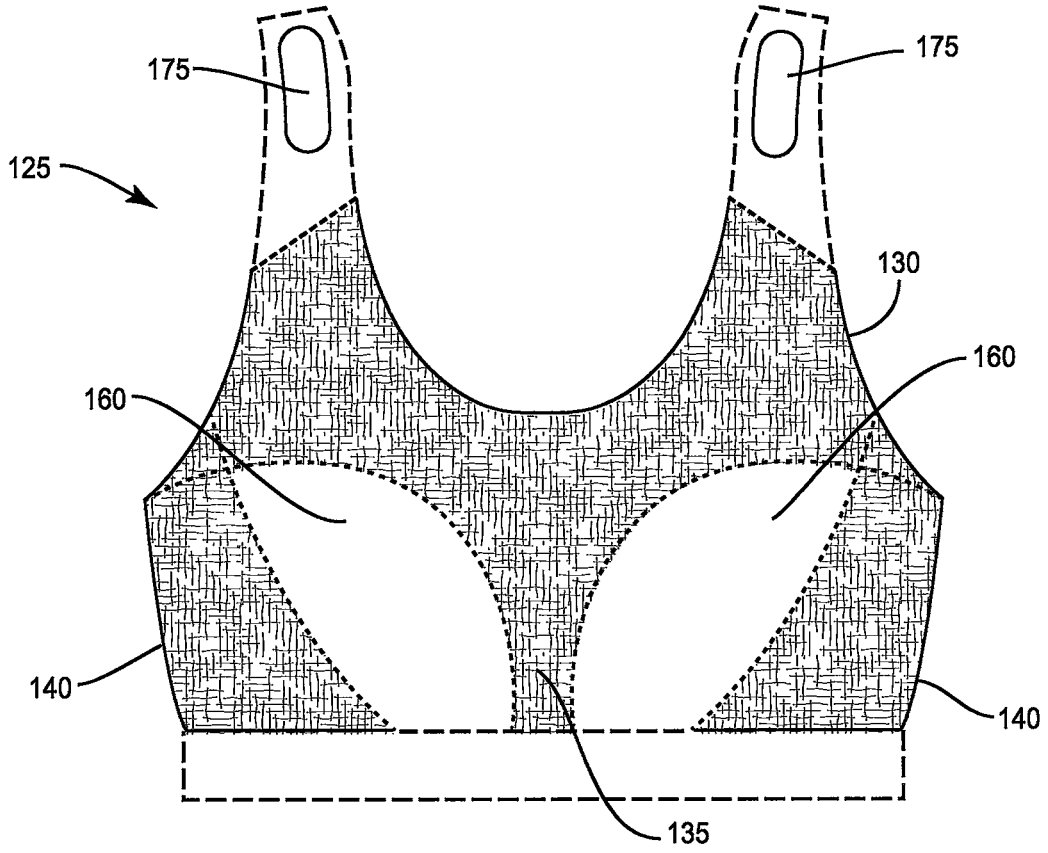
FIG. 4 is schematic of a front, intermediate layer provided within some embodiments of a bra of the present disclosure.

As best shown in FIG. 4, the intermediate fabric ply 125 provides a support structure disposed between the outer fabric ply 115 and the inner fabric ply 120. The intermediate fabric ply 125 comprises a fabric, preferably a mesh. In one embodiment, the mesh fabric is formed of 83% nylon and 17% spandex. The disclosure, however, is not limited to the use of such fabric for the intermediate ply and other suitable fabrics are within the scope of the disclosure, including, for example, fabrics made from rayon, polyester, polypropelene and other elastomeric yarns.

As may be appreciated, the intermediate fabric ply 125 includes a greater percentage of nylon than the inner fabric ply 120 and the outer fabric ply 115. The mesh structure, coupled with the increased percentage of nylon, can provide the intermediate fabric ply 125 with a higher modulus of elasticity i.e., a greater resistance to stretching, than that of the inner fabric ply 120 and outer fabric ply 115. In other words, the intermediate fabric ply 125 should have a lesser degree of stretch. The higher modulus of elasticity of the intermediate fabric ply 125 increases the ability of the intermediate fabric ply 125 to provide support to the breasts of the wearer of bra 1. Each mesh structure results in a relative coarse fabric and is disposed between the inner and outer fabric plies to reduce contact with the skin of the wearer, thereby avoiding chaffing.

With continued reference to FIG. 4, the support structure defined by the intermediate fabric ply 125 includes a first upper portion 130 and a pair of second lower portions 140. The first portion 130 is configured to correspond with the top of the cover region 110, and to be located generally above the breasts of the wearer, enhancing the bra's control of up and down motion of the wearer's breasts. In some embodiments, an additional strip 135 can extend downwardly from near the center of the first portion 130. This additional strip 135 will then be generally disposed between the wearer's breasts. The pair of second lower portions 140 are positioned to correspond with the lateral sides of the wearer's breasts, enhancing the bra's control of side to side motion of the wearer's breasts Still referring to FIG. 4, the intermediate fabric ply 125 of at least some embodiments at least partially defines a pair of substantially annular-shaped, i.e., centrally open, support pockets 160. Such a configuration helps to reduce the overall bulk of the bra 1, and also places the portions of the intermediate fabric ply 125 into those areas where the relatively more moisture collects. The use of mesh to form the intermediate fabric ply 125 also increases the breathability of the bra 1 in such relatively high moisture areas.

Returning to FIG. 1, the front portion 100 further comprises a brace region 150 along the lower and lateral periphery portions of the bust region 110, configured to provide support to the bottom and sides of a wearer's breasts when the bra 1 is worn. The brace region 150 can form the bottom of the front portion 100 and be sewn to the torso band 300. Preferably the brace region 150 is defined by at least one ply of a supportive fabric, such as the mesh used to form the intermediate fabric ply 125. The brace region 150 can also partially define a portion of the annular support pockets 160, completed by the material of the intermediate fabric ply 125. In one embodiment, at least part of the brace region 150 includes two plies of the supportive fabric mesh used to form the intermediate fabric ply 125. Preferably, the center of the brace region 150 includes the two mesh plies, resulting in increased breathability in this area due to the use of the porous mesh.

The front portion 100 further comprises shoulder portions 170. The shoulder portions 170 can include the outer fabric ply 115 and the inner fabric ply 120 extending from the bust region 110. Preferably a single piece of fabric will form the outer fabric ply 115 for the bust region 110 and both shoulder portions 170; however multiple pieces could be sewn or otherwise bonded together. In one embodiment, the shoulder portions 170 include a gel layer 175 disposed between the outer fabric ply 115 and the inner fabric ply 120. The gel layer 175 acts as a cushion at or near the uppermost shoulder portion of the bra 1 when worn.

The front portion 100 may further comprise a pair of lateral regions 180 respectively disposed laterally outward of the bust region 110, and optionally, the brace region 150. The lateral regions 180 act as the transition between the front portion 100 and the back portion 200. In some embodiments, the fabric forming the lateral regions 180 may be laminated in order to increase stability. One possible laminate is Delnet® Film available from DelStar Technologies, Inc. of Middletown, Del. as product number #PQ218NAT.

Referring to FIG. 2, the bra 1 includes a back portion 200. The back portion 200 is generally considered as the portion of bra 1 configured to be worn adjacent to the back of the wearer. The back portion 200 extends laterally between the pair of lateral regions 180 to connect the back portion 200 to the front portion 100. The back portion 200 also extends between the torso band 300 and the pair of shoulder straps 400. The back portion 200 can have a body portion 210 and a connector portion 240. The body portion 210 includes a lower edge 215 and an upper edge 220. In one embodiment, the lower edge 215 is attached to the torso band 300 by sewing or other known joining or bonding techniques. The upper edge 220 is spaced above the torso band 300. In one embodiment, the body portion 210 can be a two-ply construction with an exterior ply of mesh as used for the intermediate fabric ply 125 and an interior ply having the same material as the inner fabric ply 120 of the front portion 100.

Continuing with FIG. 2, the connector portion 240 is formed separately from and then joined to the body portion 210. The connector portion 240 may be disposed to project upwardly from the torso band 300 and connect with the shoulder straps 400, for example, by using sliders 410 formed of coated metal. In one embodiment the connector portion 240 is attached to the bra 1 at a seam between the torso band 300 and the lower edge 215 of the body portion 210 and the upper edge 220 of the body portion 210. The connector portion 240 may so be attached to the bra 1 at the upper edge 220 of the body portion 210 by stitching 245. Preferably the connector portion 240 will only be attached to the body portion 210 at these two locations, while otherwise being unattached to the body portion 210.

The connector portion 240 is configured to have a narrow width adapted for a comfortable placement between the shoulder blades of the wearer and further reducing the likelihood of chaffing. The connector portion 240 may also include a two-ply construction, each ply comprising the mesh fabric used in the intermediate fabric ply 125.

Figure 3:
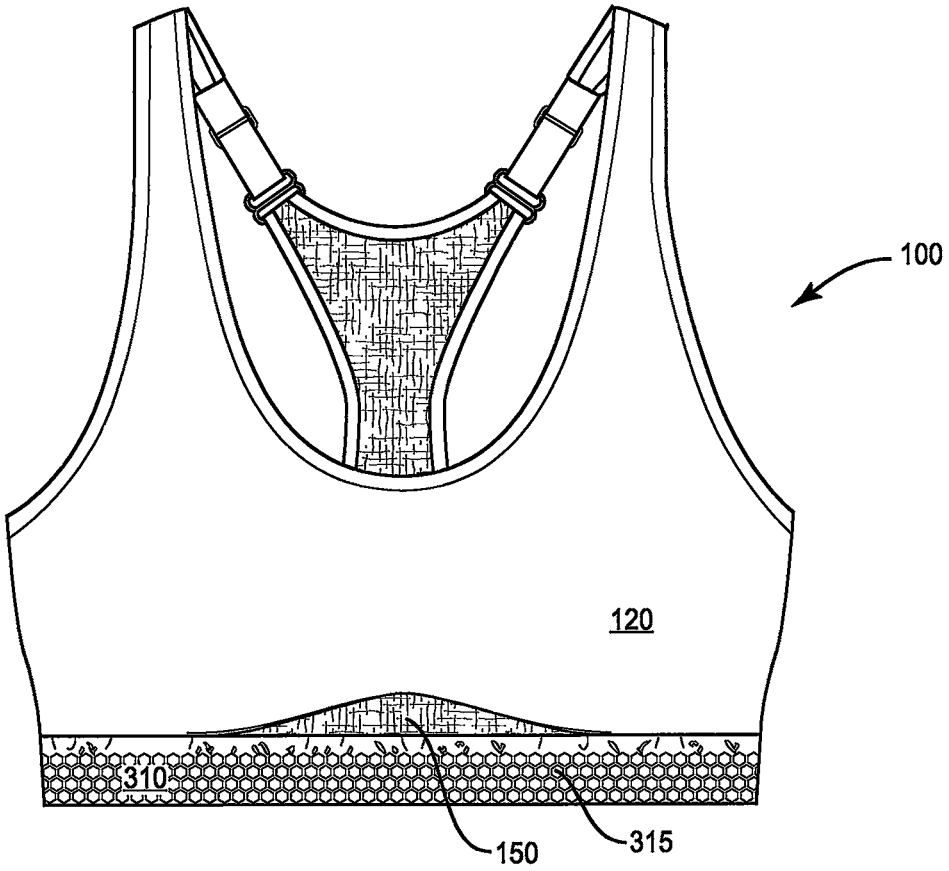
FIG. 3 is an inner, front view of a bra according to embodiments of the present disclosure.

Referring to FIGS. 2 and 3, torso band 300, with outside surface 305 and inside surface 310, can also include features intended to enhance performance of the bra 1. In one embodiment, the torso band 300 is a brushed material including at least one of polyester and nylon. The brushed nature of the material provides a soft feel for reduced friction and chaffing. The brushed material of the torso band may be obtained from Regina Miracle International, Ltd. of Kwai Chung, Hong Kong. The torso band 300 may also be treated in order to enhance the moisture wicking ability of the fabric.

Continuing with FIG. 3, in one embodiment, the torso band 300 is constructed to include a closely spaced honeycomb pattern. As shown in FIG. 3, the cells 315 of the honeycomb pattern form raised portions of the torso band 300 along the inside surface 310 thereof. These raised cells 315 provide a soft and smooth contact surface with the skin, while the raised cells 315 also limit movement between the torso band 300 and the skin.

Returning to FIG. 1, shoulder straps 400 are placed between the connector portion 240 and the shoulder portions 170. These shoulder straps 400 may be attached at each of their respective ends by bonding, sewn seams or sliders 410. In a preferred embodiment, the shoulder straps 400 will include sliders 410 along the length thereof and connected thereto in such a fashion that the shoulder straps 400 will be adjustable in length. The ability to adjust the length of shoulder straps 400 will provide a customizable fit.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A bra comprising:

a. a front portion configured to cover the breasts of a wearer;

b. a back portion connected to the front portion configured to surround a torso of the wearer;

c. a torso band attached along a bottom edge of the front portion and the back portion; and d. a pair of shoulder straps connected between the front portion and the back portion, wherein at least a breast cover region of the front portion comprises an outer fabric ply, an inner fabric ply, and a supportive intermediate fabric ply disposed between the inner fabric ply and outer fabric ply such that the outer fabric ply and the inner fabric ply cover the intermediate fabric ply, the intermediate fabric ply comprising a first portion positioned at a top of the breast cover region and a pair of second portions positioned to correspond with lateral sides of the wearer's breasts;

wherein the intermediate fabric ply comprises a first fabric having a first degree of stretch and the inner and outer fabric plies comprise at least a second fabric having a second degree of stretch, the first degree of stretch being less than the second degree of stretch; and wherein the fabric comprises a mesh.

2. The bra of claim 1, wherein the first portion includes a strip extending downward from a center thereof configured to be positioned generally between the wearer's breasts when the bra is worn.

3. The bra of claim 1, wherein the front portion comprises a brace region, the brace region positioned at least partially between the breast cover region and the torso band, and extending from a seam configured to be located adjacent to a first armpit of the wearer, along lower and lateral peripheral portions of the breast cover region, and up to a seam configured to be located adjacent to a second armpit of the wearer.

4. The bra of claim 3, wherein the intermediate fabric ply and the brace region of the front portion form a pair of substantially annular shaped support pockets.

5. The bra of claim 3, wherein the brace region comprises at least one ply of the first fabric.

6. The bra of claim 1, wherein the front portion includes a pair of shoulder portions extending from the top of the breast cover region, each shoulder portion of the pair of shoulder portions are connected to a respective shoulder strap of the pair of shoulder straps.

7. The bra of claim 6, wherein the pair of shoulder portions include the outer fabric ply, the inner fabric ply, and a gel layer disposed between the outer fabric ply and the inner fabric ply.

8. The bra of claim 1, wherein the torso band comprises a brushed fabric.

9. The bra of claim 8, wherein the brushed fabric comprises at least one of polyester and cotton.

10. The bra of claim 8, wherein the torso band has an outside surface and an inside surface, the inside surface comprising a honeycomb pattern having raised cells.

11. The bra of claim 8, wherein the torso band is treated to enhance wicking.

12. The bra of claim 1, wherein at least the inner fabric ply and the outer fabric ply are treated to provide wicking capability; wherein the wicking capability of the inner fabric ply and the outer fabric ply is configured to increase as temperature surrounding the bra increases.

13. The bra of claim 1, wherein the front portion comprises a brace region along a lower lateral periphery of the breast cover region, the brace region connecting the outer fabric ply of the breast cover region to the torso band, the brace region comprising the first fabric having the first degree of stretch less than the second degree of stretch of the second fabric.

14. The bra of claim 1, the back portion further comprising:

a) a body portion; and b) a connector portion having a narrow width and adapted for placement between shoulder blades of the wearer, the connector portion formed separately from the body portion and then joined to the body portion;

wherein, the body portion comprises a lower edge attached to the torso band and an upper edge spaced from the torso band, the body portion is disposed along the torso band to join with each lateral side of the front portion, and wherein the connector portion attaches to the torso band about the lower edge of the body portion, projects upward from the torso band and connects with the pair of shoulder straps, and attaches to the body portion at the upper edge of the body portion, wherein the connector portion overlaps a portion of the body portion between the lower edge of the body portion and the upper edge of the body portion.

15. The bra of claim 14, wherein the connector portion comprises a mesh fabric.

16. The bra of claim 14, the front portion further comprises a pair of shoulder portions extending from the top of the breast cover region, each shoulder portion of the pair of shoulder portions connected to a respective shoulder strap of the pair of shoulder straps;

wherein the pair of shoulder straps are adjustable in length.

17. A bra comprising:

a) a front portion configured to cover breasts of a wearer;

b) a back portion connected to the front portion configured to, in combination with the front portion, surround a torso of the wearer; the back portion comprising:

i) a body portion; and ii) a connector portion having a narrow width and adapted for placement between shoulder blades of the wearer, the connector portion formed separately from the body portion and then joined to the body portion;

c) a torso band; and d) a pair of shoulder straps connected between the front portion and the back portion, wherein the body portion comprises a lower edge attached to the torso band and an upper edge spaced from the torso band, the body portion disposed along the torso band to join with each lateral side of the front portion, the front portion comprising a breast cover region having an outer fabric ply, an inner fabric ply, and a supportive intermediate fabric ply disposed between the inner fabric ply and the outer fabric ply such that the outer fabric ply and the inner fabric ply cover the intermediate fabric ply, the intermediate fabric ply comprising a first portion positioned at a top of the breast cover region and a pair of second portions positioned to correspond with lateral sides of the wearer's breasts;

wherein the intermediate fabric ply comprises a first fabric having a first degree of stretch and the inner and outer fabric plies comprise at least a second fabric having a second degree of stretch, the first degree of stretch being less than the second degree of stretch, and wherein the first fabric comprises a mesh; and wherein the connector portion attaches to the torso band about the lower edge of the body portion, projects upward from the torso band and connects with the pair of shoulder straps, and attaches to the body portion at the upper edge of the body portion, wherein the connector portion overlaps a portion of the body portion between the lower edge of the body portion and the upper edge of the body portion.

18. The bra of claim 17, wherein the connector portion comprises the first fabric.

19. The bra of claim 17, wherein the connector portion is attached to the body portion only at a portion of the lower edge of the body portion that the connector portion overlaps and at a portion of the upper edge of the body portion that the connector portion overlaps, and wherein the connector portion is otherwise unattached to the body portion.

* * * * *